US007679477B2

(12) United States Patent
Portier

(10) Patent No.: US 7,679,477 B2
(45) Date of Patent: Mar. 16, 2010

(54) CONTACTOR WITH MODULAR CONNECTION OF THE COIL

(75) Inventor: Alain Portier, Lyons (FR)

(73) Assignee: ABB France, Rueil Malmaison (FR)

( * ) Notice: Subject to any disclaimer, the term of this patent is extended or adjusted under 35 U.S.C. 154(b) by 182 days.

(21) Appl. No.: 11/907,090

(22) Filed: Oct. 9, 2007

(65) Prior Publication Data

US 2008/0106362 A1 May 8, 2008

(30) Foreign Application Priority Data

Nov. 2, 2006 (FR) ..... 06 09590

(51) Int. Cl.
*H01H 67/02* (2006.01)

(52) U.S. Cl. ..... 335/132; 335/71; 335/78; 335/83; 335/86; 335/130; 335/131; 335/133; 335/199; 335/202; 335/162; 335/281; 439/76.1; 439/95; 439/248; 439/278; 439/282; 439/467; 439/620.1; 439/620.18; 200/168; 220/3.2; 361/627

(58) Field of Classification Search ..... 335/162, 335/202, 71, 78–86, 130–133, 199, 281; 439/76.1, 95, 248, 278, 282, 467, 620.1, 439/620.18; 200/168; 220/3.2; 361/627
See application file for complete search history.

(56) References Cited

U.S. PATENT DOCUMENTS

| | | | | | |
|---|---|---|---|---|---|
| 3,763,448 | A * | 10/1973 | Walters | ..... | 335/135 |
| 4,647,886 | A * | 3/1987 | Schmiedel et al. | ..... | 335/132 |
| 4,717,899 | A * | 1/1988 | Drexler et al. | ..... | 335/131 |
| 4,980,801 | A * | 12/1990 | Guinda et al. | ..... | 361/730 |
| 5,517,167 | A | 5/1996 | Yamamoto et al. | | |
| 5,578,980 | A * | 11/1996 | Okubo et al. | ..... | 335/132 |
| 5,724,018 | A | 3/1998 | Brandl et al. | | |
| 5,870,278 | A * | 2/1999 | Girard et al. | ..... | 361/627 |
| 6,515,850 | B2 * | 2/2003 | Fournier et al. | ..... | 361/627 |
| 7,414,828 | B2 * | 8/2008 | Birner | ..... | 361/624 |
| 7,538,647 | B2 * | 5/2009 | Leopold | ..... | 335/199 |
| 2003/0016105 | A1 * | 1/2003 | Bauer et al. | ..... | 335/132 |
| 2008/0100405 | A1 * | 5/2008 | Portier | ..... | 335/161 |
| 2008/0174391 | A1 * | 7/2008 | Bolz et al. | ..... | 335/202 |

FOREIGN PATENT DOCUMENTS

| | | | |
|---|---|---|---|
| DE | 30 17 561 | A1 | 11/1981 |
| DE | 44 06 682 | A1 | 9/1994 |
| DE | 10 2004 009650 | B3 | 7/2005 |
| EP | 0 707 740 | B1 | 11/1996 |
| WO | WO 2006/084421 | A1 | 8/2006 |

* cited by examiner

*Primary Examiner*—Anh T Mai
*Assistant Examiner*—Mohamad A Musleh
(74) *Attorney, Agent, or Firm*—Oliff & Berridge, PLC

(57) ABSTRACT

A contactor with modular connection of the coil according to the invention comprises an insulating body, an operating coil housed in the insulating body, and means of modular connection of the coil to an external circuit so that the coil can be powered. The coil connection means comprise a connection arrangement, internal to the body, comprising at least two pairs of contact pieces positioned near at least two faces of the insulating body, these two faces being chosen from the front face and two opposed side faces running transversely between the front face and the rear face, each contact piece facing an opening in the body, and at least one removable connection module comprising a pair of connection terminals, which is connected to a second pair of contacts which are intended to collaborate with a first pair of contact pieces of the internal connection arrangement.

12 Claims, 7 Drawing Sheets

CONTACTOR WITH MODULAR CONNECTION OF THE COIL

BACKGROUND OF THE INVENTION

The present invention relates to a contactor with modular connection of the coil.

In a known way, a contactor comprises:

an insulating body delimited by a front face; a rear face comprising means of attachment to a support, an operating coil housed in the insulating body, and means of modular connection of the coil to an external circuit so that the coil can be powered.

The connection means may be positioned on a side face of the contactor running transversely between the front face and the rear face, on two side faces, or on the front face, depending on the models, there being no standardized location for these.

If it is desirable to provide the customer with a number of connection options, it is known practice to provide connection means on several faces of the contactor, causing the contactor to occupy a larger amount of space and increasing the complexity and cost of this contactor.

It is also known practice to use modular connection means.

DESCRIPTION OF THE PRIOR ART

Document EP 0 707 740 in particular describes a contactor of this type comprising removable terminals of two different types which are fitted individually to connection locations on two opposed side faces.

This solution does actually allow a modular connection to be made. However, this device entails mounting the coil-connection terminals on the contactor in several stages.

SUMMARY

It is an object of the present invention to propose an alternative modular solution that allows simplified fitting of the contactor while at the same time offering additional connection options.

To this end, the subject of the present invention is a contactor of the aforementioned type, wherein the coil connection means comprise:

a connection arrangement, internal to the body, comprising at least two pairs of contact pieces positioned near at least two faces of the insulating body, these two faces being chosen from the front face and two opposed side faces running transversely between the front face and the rear face, each contact piece facing an opening in the body, and at least one removable connection module comprising a pair of connection terminals, which is connected to a second pair of contacts which are intended to collaborate with a first pair of contact pieces of the internal connection arrangement.

These measures make it possible to produce a modular contactor that can be fitted in a single operation with a body and a connection module comprising the terminals needed for connecting in a number of different orientations.

For preference, at least one pair of contact pieces is positioned on one face of the insulating body in such a way that the two contact pieces of the pair lie respectively close to two opposed edges of the face.

These measures make it easier to pass the means of connection between the contacts and the ends of the winding of the coil.

Advantageously, the contactor comprises at least two first pairs of contact pieces positioned respectively facing the front face and facing a side face running transversely between the front face and the rear face.

These measures mean that all possible positions can be offered in a modular form.

According to one embodiment, a removable connection module intended to be positioned at the front face is different in structure than a removable connection module intended to be positioned at a side face.

This measure in particular allows additional separate functionalities to be housed in different modules intended to be positioned respectively on the front face or on the side faces.

For preference, the contact pieces intended to collaborate with one another and belonging to the first and second pairs respectively have an elastic portion, particularly one consisting of an elastic clip or an elastic loop, and a rigid portion, particularly one consisting of a rigid tab.

Advantageously, the removable connection module comprises means of attachment to the insulating casing.

These measures allow the connection module to be attached not only through the action of the contacts but also through means of attachment by way of the insulating parts, thus avoiding excessive strain on the contacts.

According to one embodiment, the connection internal arrangement comprises a printed circuit on an insulating substrate for electrical connection between the contact pieces and the coil.

These measures in particular allow the incorporation of additional functionalities for controlling the supply of power to the coil.

Advantageously, at least one contact piece is produced in the form of a surface mount (SM) component.

These measures allow the contact to be connected directly to the electronic board.

For preference, the connection internal arrangement comprises at least one metal connecting strip for connection to the ends of the winding of the coil.

It is possible for all of the coil connections internal to the insulating body to be achieved using a collection of conducting strips or it is possible to use connecting strips and an electronic board in combination.

Advantageously, the removable connection module also comprises additional functions of the timer or interface unit type.

Advantageously, a removable connection module intended to be positioned at the front face also comprises auxiliary contacts associated with the movement of the main slider of the contactor.

Advantageously, the first pair of contact pieces positioned facing the front face of the body is positioned along a diagonal of this face.

BRIEF DESCRIPTION OF THE DRAWINGS

In any event, the invention will be clearly understood with the aid of the description which follows, given with reference to the attached schematic drawing which, by way of nonlimiting example, depicts one embodiment of an equipment according to the invention.

Figure 1:
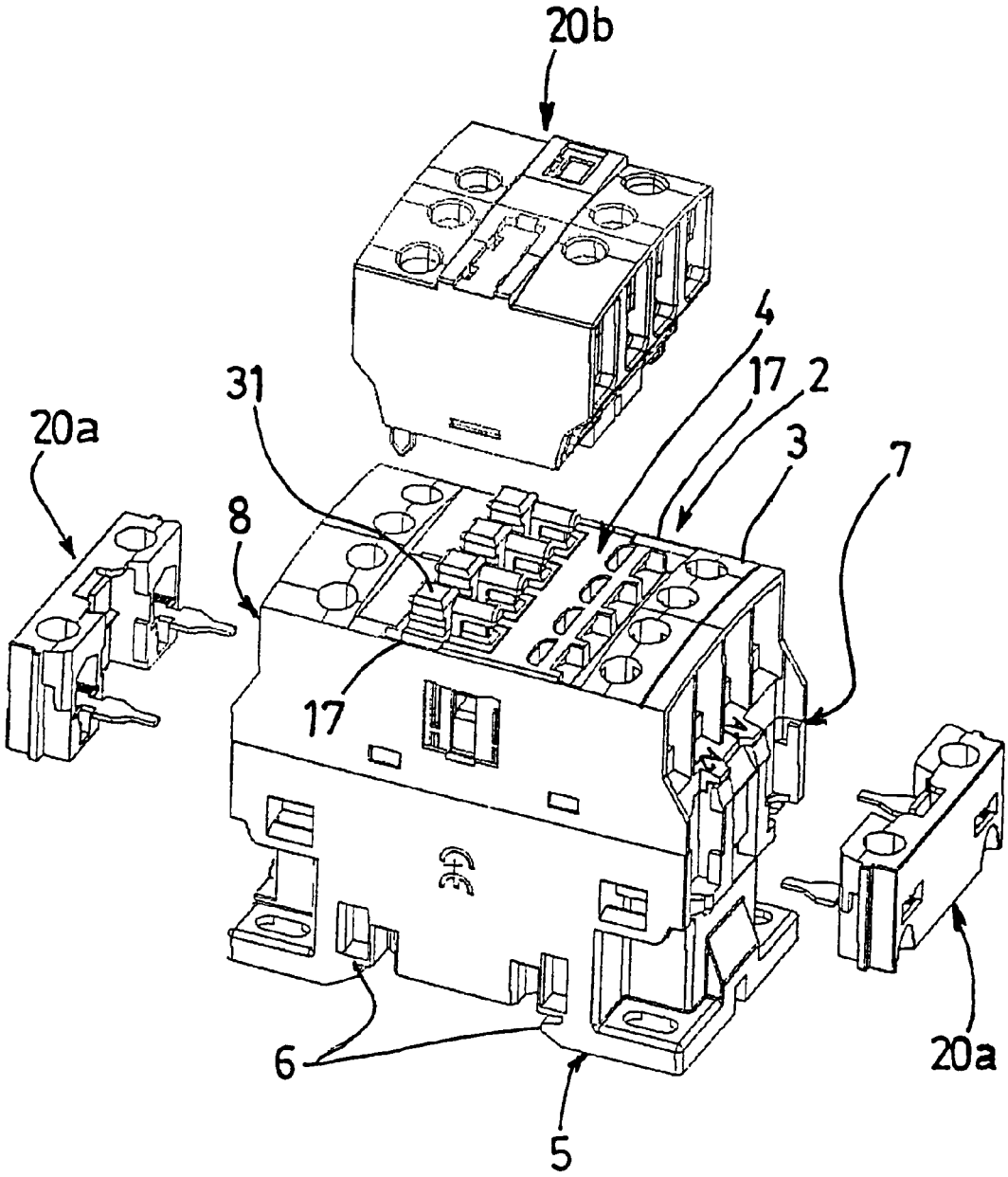
FIG. 1 is a perspective view of a first contactor according to the invention, with detached removable connection modules.
Figure 2:
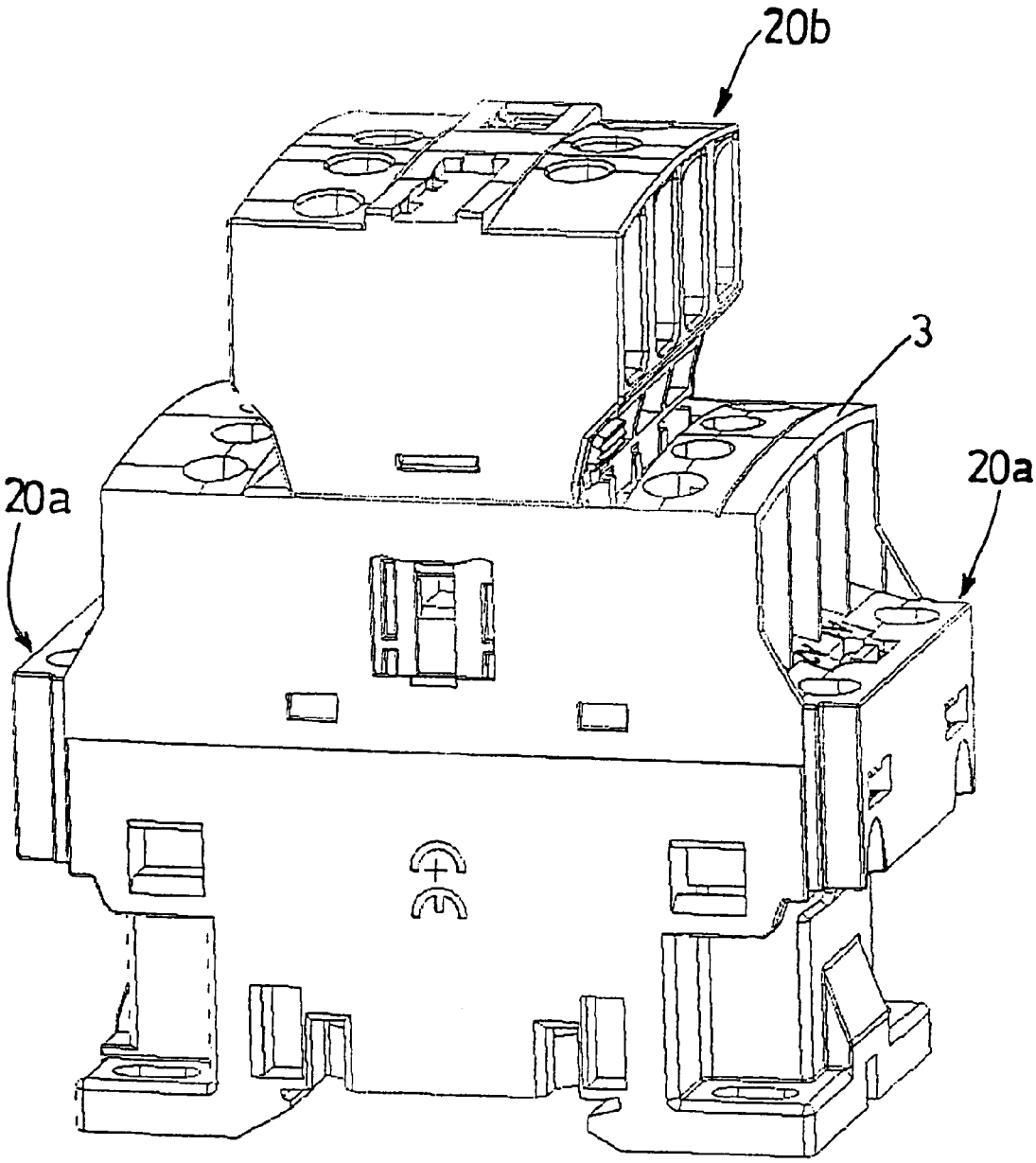
FIG. 2 is a perspective view of the contactor of FIG. 1 with three connection modules attached to the contactor.
Figure 3:
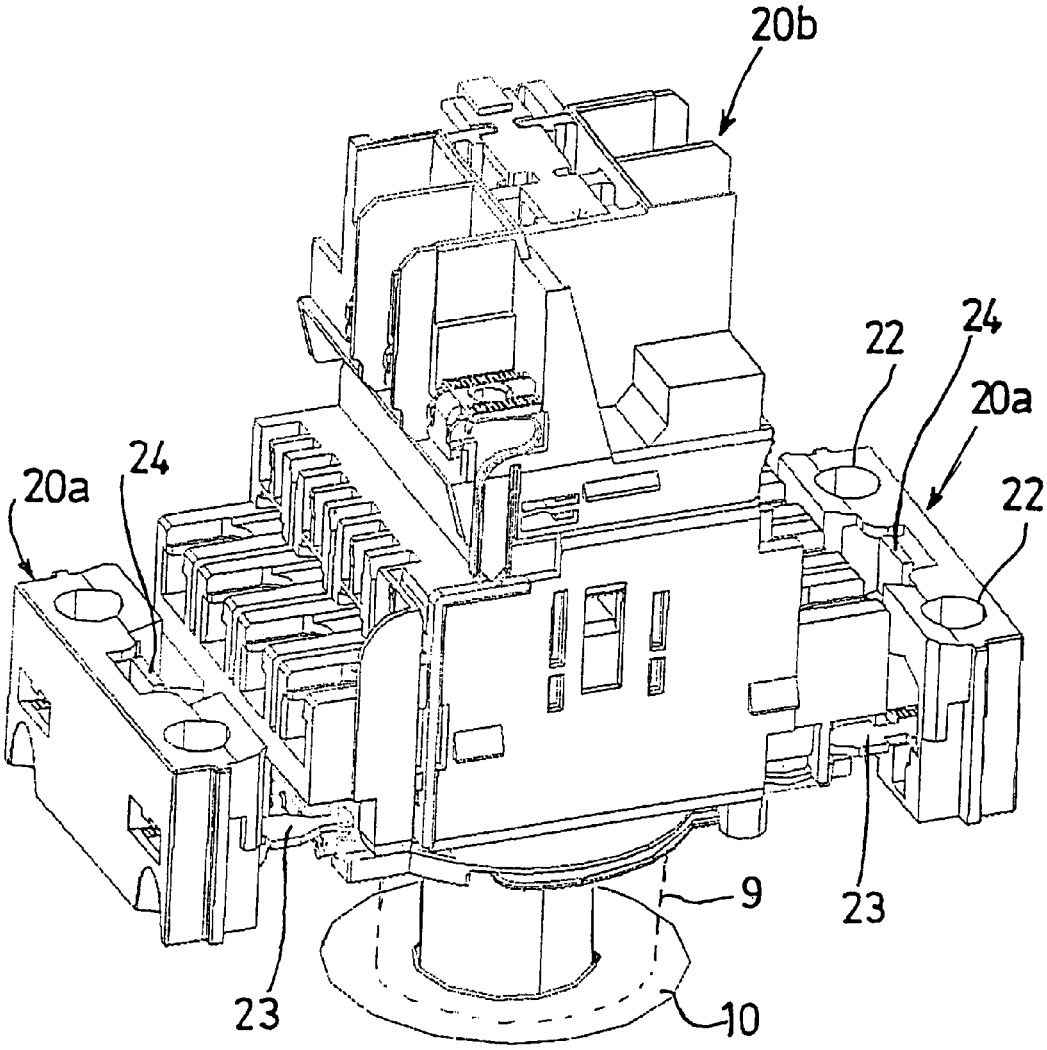
FIG. 3 is a perspective view with the set-up of FIG. 3, part of the insulating body of the contactor and of the connection modules having been omitted.
Figure 4:
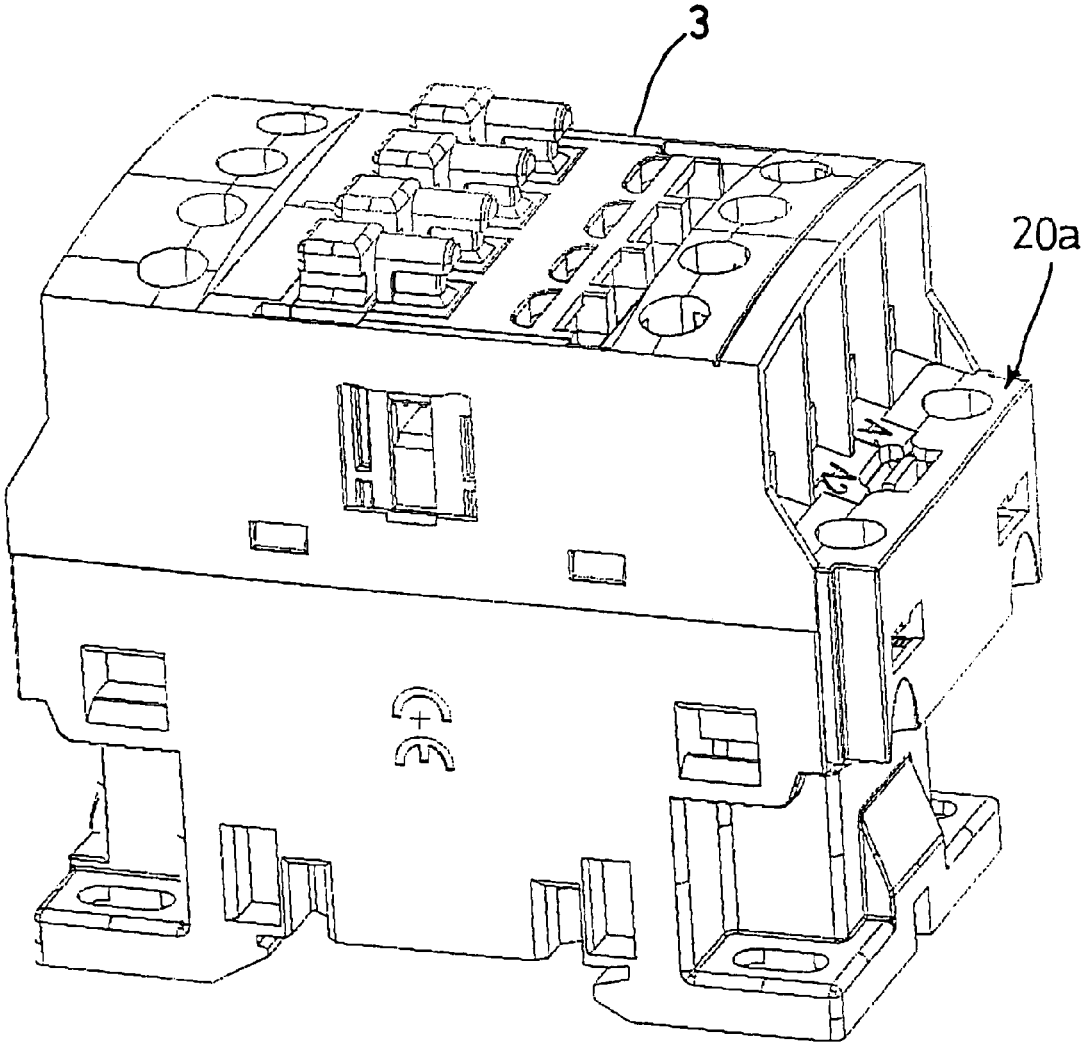
FIG. 4 is a perspective view of the contactor of FIG. 1 with one connection module attached to the contactor.
Figure 5:
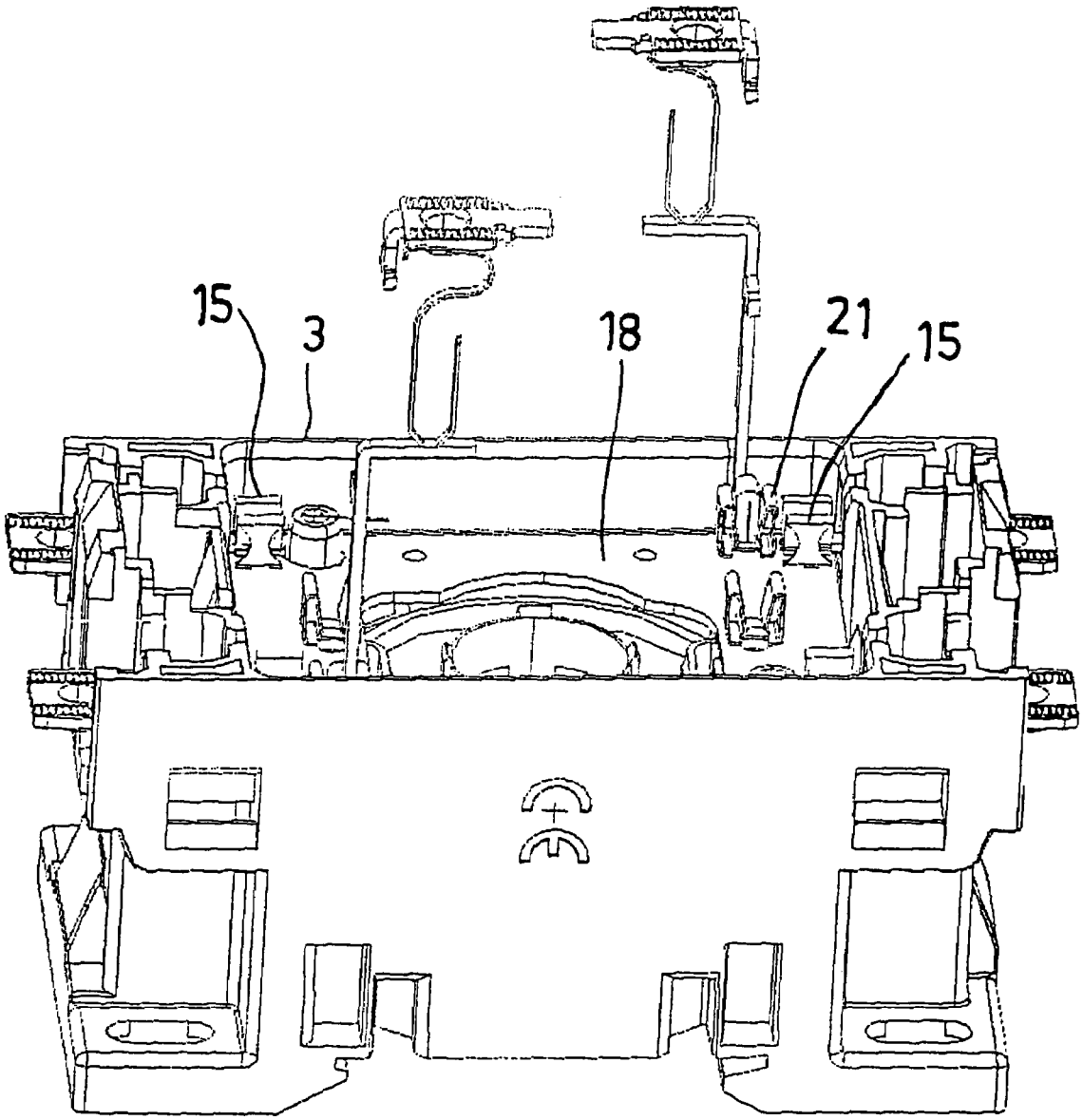
FIG. 5 is a perspective view of part of the contactor of FIG. 1, part of the insulating body of which has been omitted.
Figure 6:
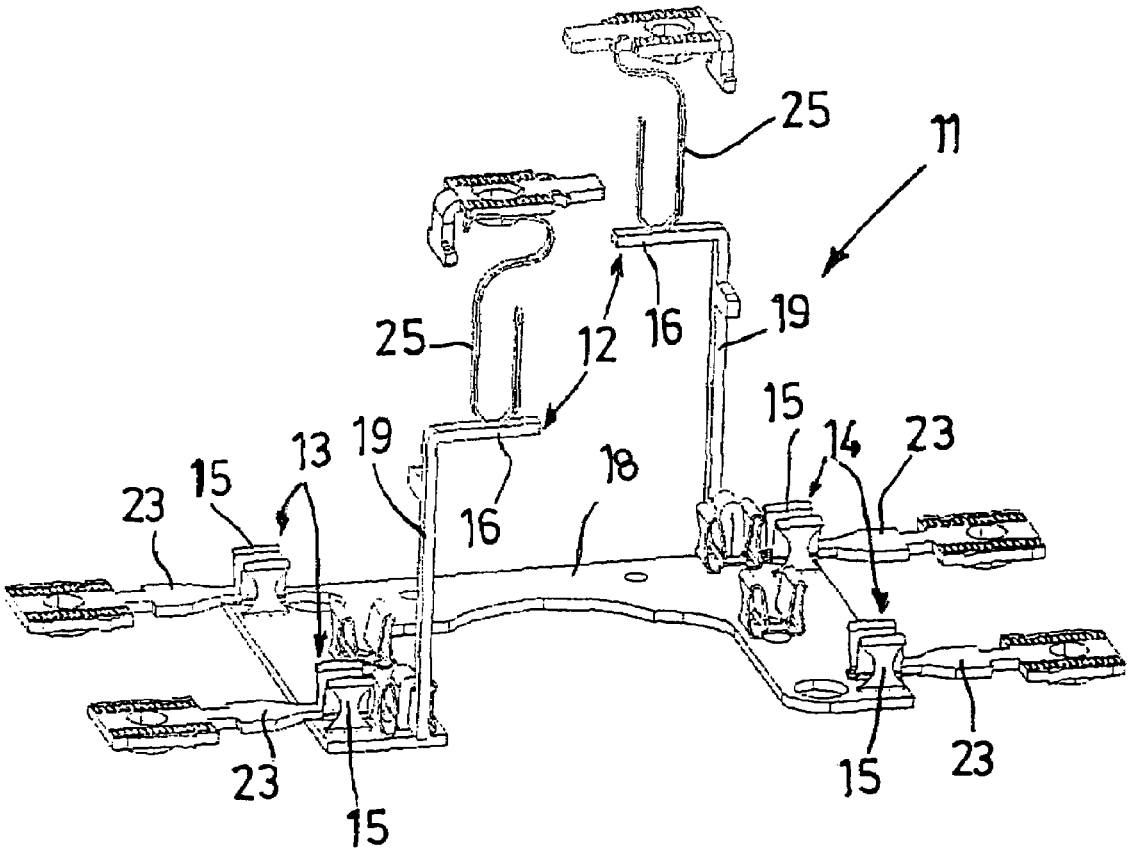
FIG. 6 is a perspective view of part of the coil connection means of the contactor of FIG. 1.

It should be noted that FIGS. 2 and 3 do not correspond to a use of the contactor, a maximum of two modules being used for connecting the coil.

DETAILED DESCRIPTION OF THE PREFERRED EMBODIMENTS

According to a first embodiment depicted in FIGS. 1 to 7, a contactor 2 according to the invention comprises an insulating body 3 delimited by a front face 4, a rear face 5 comprising means 6 of attachment to a support rail, opposed upstream 7 and downstream 8 side faces located one on each side of the support rail.

An operating coil 9 is housed in the insulating body 3, its winding positioned around a support 10.

The contactor 2 comprises a first internal arrangement 11 for connecting the coil 9 to an external circuit so that the coil can be powered, this arrangement comprising three pairs 12, 13, 14 of contact pieces 15, 16 positioned near and facing front 4, upstream 7 and downstream 8 faces of the body 3 facing an opening 17 in the body 3. The contact pair 12 facing the front face 4 is positioned, by way of example, diagonally with respect to the support rail.

The contact pieces 15 of the first pairs 13, 14 positioned facing the upstream 7 and downstream 8 faces are produced in the form of elastic connectors of SM type. The electrical connection between each contact piece 15 and an end of the winding of the coil 9 is made by way of a printed circuit 18 on an insulating substrate. This printed circuit may form part of an electronic board which also performs other functions.

The contact pieces 16 of the contact pair 12 situated facing the front face are produced in the form of a rigid tab forming the end of a strip 19 connected to the printed circuit 18 at an SM component in the form of a clip 21.

The contact pieces 15 of the first pairs 13, 14 positioned facing the upstream 7 and downstream 8 faces are situated respectively near two opposed edges of the upstream 7 and downstream 8 faces. These two edges are the edges formed by the upstream or downstream face and the faces perpendicular to the direction of the support rail.

The contact pieces 16 of the contact pair 12 situated facing the front face are situated respectively near two opposed edges of the front face 4. These two edges are the edges formed by the front face and the faces perpendicular to the direction of the support rail.

The connection means also comprise a removable connection module 20*a*, 20*b*. Two types of module of differing structures 20*a*, 20*b* are used according to whether the module is intended to be fixed to the front face 4 or to an upstream 7 or downstream 8 face.

A module 20*a* intended to be attached to an upstream 7 or downstream 8 face has an insulating body comprising a pair of connection terminals 22 which is connected to a second pair of contacts 23 which are intended to collaborate with the pairs of contact pieces 15 belonging to the body. For this, the second contacts 23 of the connection module are produced in the form of rigid tabs.

The removable connection module 20*a* comprises means 24 of attachment to the insulating body 3, in the form of an elastic tab intended to collaborate with a housing belonging to the body 3.

A connection module 20*b* intended to be positioned at the front face comprises second contact pieces 25 in the form of elastic loops intended to collaborate with contact pieces 16 in the form of rigid tabs.

This module comprises means of attachment to the front face which consists of elastic clip-fastening parts intended to collaborate with an attachment finger 31 belonging to the insulating body 3 and formed on the front face and comprising lateral grooves.

Advantageously, the removable connection module 20*b* intended to be positioned at the front face also comprises auxiliary contacts.

According to another alternative form, the removable connection module 20*a*, 20*b* also comprises additional functions of the timer or interface unit type.

Figure 7:
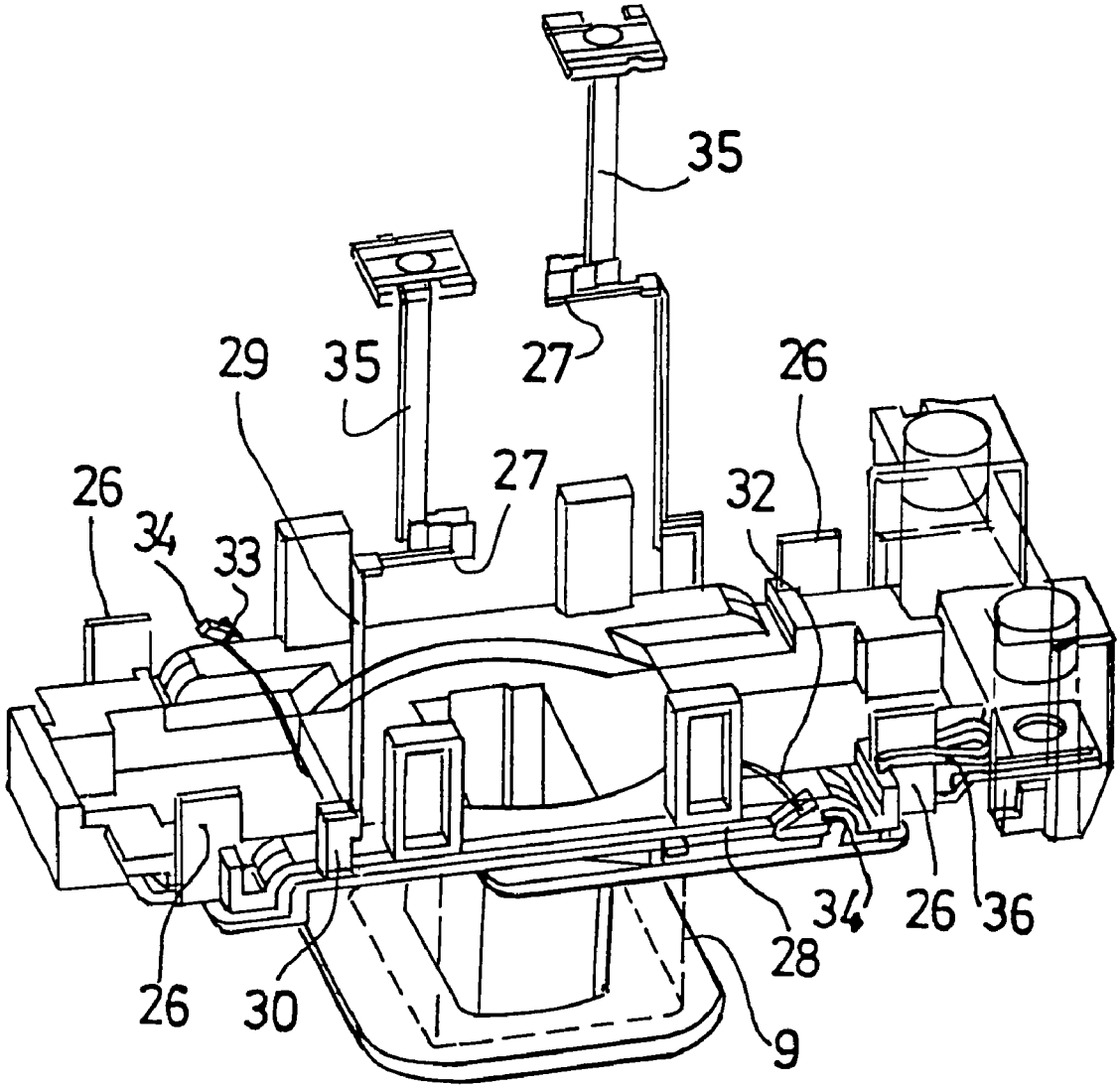
FIG. 7 is a perspective view showing the coil connection means according to a second embodiment.

According to a second embodiment, some of the connection means of which are depicted in FIG. 7, each contact piece 26, 27 of one pair is connected to one end of the winding of the coil 9 by a conducting setup comprising a first conducting strip 28 joining the contact pieces 26 which face the upstream and downstream faces, and a second conducting strip 29, in contact at one of its ends with the first conducting strip 28 via a first elastic clip 30, and at its second end forming the contact piece 26 facing the front face 4.

The end 32, 33 of the winding of the coil 9 is connected to the setup at a tab 34 formed on the first conducting strip 28.

It should be noted that, in this embodiment, the contacts 26 facing the upstream and downstream faces consist of rigid tabs, and the contacts 27 situated facing the front face consist of elastic clips. The contacts of a connection module intended to be positioned on a front face consist of a rigid tab 35 and the contacts of a connection module intended to be positioned on a front face consist of an elastic clip 36.

As goes without saying, the invention is not restricted to the preferred embodiment described hereinabove by way of non-limiting example; on the contrary, it encompasses all variations thereof.

In particular, while the connection terminals shown in the figures are terminals of the screw-connection type, other connection terminals, for example of the sprung type or some other type, may be used.

The invention claimed is:

1. A contactor with modular connection of the coil, comprising:

an insulating body delimited by a front face and a rear face comprising means of attachment to a support, an operating coil housed in the insulating body, and means of modular connection of the coil to an external circuit so that the coil can be powered, wherein the coil connection means comprise:

a coil connection arrangement, internal to the body, comprising at least two pairs of contact pieces positioned near at least two faces of the insulating body, these two faces being chosen from the front face and two opposed side faces running transversely between the front face and the rear face, each contact piece facing an opening in the body, and at least one removable connection module comprising a first pair of connection terminals and a second pair of contacts which is connected to the first pair of connection terminals and which are intended to collaborate with at least one of the pair of contact pieces of the internal coil connection arrangement.

2. The contactor as claimed in claim 1, in which at least one pair of contact pieces of the internal coil connection arrangement is positioned on one face of the insulating body in such a way that the two contact pieces this pair lie respectively close to two opposed edges of the face.

3. The contactor as claimed in claim 1, comprising at least two pairs of contact pieces of the internal coil connection arrangement positioned respectively facing the front face and facing a side face running transversely between the front face and the rear face.

4. The contactor as claimed in claim 1, in which a removable connection module intended to be positioned at the front face is different in structure than a removable connection module intended to be positioned at a side face.

5. The contactor as claimed in claim 1, in which the contact pieces intended to collaborate with one another and belonging to the first and second pairs respectively have an elastic portion, particularly one consisting of an elastic clip or an elastic loop, and a rigid portion, particularly one consisting of a rigid tab.

6. The contactor as claimed in claim 1, in which the removable connection module comprises means of attachment to the insulating casing.

7. The contactor as claimed in claim 1, in which the coil connection arrangement comprises a printed circuit on an insulating substrate for electrical connection between the contact pieces and the coil.

8. The contactor as claimed in claim 7, in which at least one contact piece is produced in the form of a surface mount component.

9. The contactor as claimed in claim 1, in which the coil connection arrangement comprises at least one metal connecting strip for connection to the ends of the winding of the coil.

10. The contactor as claimed in claim 1, in which the removable connection module also comprises additional functions of the timer or interface unit type.

11. The contactor as claimed in claim 1, in which the removable connection module intended to be positioned at the front face also comprises auxiliary contacts associated with the movement of a main slider of the contactor.

12. The contactor as claimed in claim 3, in which the first pair of contact pieces positioned facing the front face of the body is positioned along a diagonal of this face.

* * * * *